US006917008B1

(12) United States Patent
Ni

(10) Patent No.: US 6,917,008 B1
(45) Date of Patent: Jul. 12, 2005

(54) MICROSWITCH

(75) Inventor: Yu-Ting Ni, Taipei Hsien (TW)

(73) Assignee: Zippy Technology Corp., Hsin-Tien (TW)

( * ) Notice: Subject to any disclaimer, the term of this patent is extended or adjusted under 35 U.S.C. 154(b) by 0 days.

(21) Appl. No.: 10/913,459

(22) Filed: Aug. 9, 2004

Related U.S. Application Data

(63) Continuation-in-part of application No. 10/751,407, filed on Jan. 6, 2004, now Pat. No. 6,797,904.

(51) Int. Cl.[7] ..... H01H 15/02

(52) U.S. Cl. ..... 200/563; 200/16 C; 200/536; 200/553; 200/557

(58) Field of Search ..... 200/16 R–16 D, 200/520, 530–532, 536, 553, 557, 562, 563, 329, 339, 341

(56) References Cited

U.S. PATENT DOCUMENTS 3,878,344 A 4/1975 Lockard
3,965,319 A 6/1976 Lockard
4,081,632 A 3/1978 Schaffeler
5,796,058 A * 8/1998 Aimi et al. ..... 200/16 D
6,222,144 B1 * 4/2001 Nishikawa ..... 200/537
6,525,285 B2 * 2/2003 Kudo et al. ..... 200/559
6,559,401 B2 5/2003 Minami et al.
6,762,379 B1 * 7/2004 Su ..... 200/276.1
6,768,069 B1 * 7/2004 Su ..... 200/276.1
2002/0148714 A1 10/2002 Minami et al.

FOREIGN PATENT DOCUMENTS

TW 517254 1/2003
TW 562228 11/2003

* cited by examiner

*Primary Examiner*—Michael A. Friedhofer
(74) *Attorney, Agent, or Firm*—Birch, Stewart, Kolasch & Birch, LLP

(57) ABSTRACT

A microswtich that is easy to assemble and manufacture is provided. The microswitch constantly keeps the first conductive section of a resilient component for opening/closing an electrical switch in contact with the first conductive terminal in the main body of the microswitch, and houses a plate-shaped second conductive section with a contact surface inside the main body of the microswtich, so that the second conductive section of the resilient component is driven by a press button on the contact surface of the second conductive terminal to preset the signal from an initial connection state to a final connection state in order to increase the distance required for controlling the signal connection and allow the resilient component to have an effective deformation and provide the best resilience of the press button.

6 Claims, 9 Drawing Sheets

MICROSWITCH

This is a Continuation-in-part (CIP) application of Ser. No. 10/751,407, now U.S. Pat. No. 6,797,904, filed on Jan. 6, 2004, entitled "Microswitch".

FIELD OF THE INVENTION

The present invention generally relates to microswitches, more particularly to a microswitch that provides several operating directions for switching on/off an electric contact point.

BACKGROUND OF THE INVENTION

In view of the low precision of manufacturing and assembling "small switches" as disclosed in the R.O.C. Patent Publication No. 517254 and "lever switches" as disclosed in the U.S. Pat. No. 6,559,401, the inventor of this invention had made improvements over the foregoing prior arts and filed a R.O.C. patent application entitled "Microswitch (II)". Such patent application granted and published with Publication No. 562228 discloses an easy-to-assemble and easy-to-manufacture microswitch without changing the volume of the existing products or requiring a complicated manufacturing process or a strict precision control. The easy-to-assemble and easy-to-manufacture microswitch comprises a connecting section disposed between first and second conductive sections of a resilient component used for switching on/off an electric contact point, a fixing section coupled to the resilient component and disposed in an accommodating groove of a press button at the position corresponding to the connecting section, so that the first conductive section of the resilient component is kept constantly in contact with a first contact section of the first conductive terminal extended into a chamber, and the second conductive section is moved downward by a force produced by pressing on a pressing section of the press button at a position corresponding to the contact of the press button with a second contact section of the second conductive terminal being extended to the chamber.

Although the switch according to this patent has solved the precision problem, it still cannot meet the strict requirements of the microswitch such as the distance required for the signal connection and the quick restoration of the press button after being released mainly due to the parallel arrangement of the first and second conductive terminals disposed in the chamber of the main body. Therefore, the distance required for signal connections is limited by the provided space. In addition, the distance between the first and second conductive sections of the resilient component is short as shown in the drawings of the patent specification. Thus the compression produced by the press button is very limited, and the press button cannot quickly resume its original position after the press button is released.

SUMMARY OF THE INVENTION

The primary objective of the present invention is to overcome and avoid the foregoing shortcomings. This invention provides a microswitch that is easy to assemble and manufacture. The microswitch of this invention constantly keeps the first conductive section of a resilient component for switching on/off an electrical contact point in contact with the first conductive terminal in the main body of the microswitch, and builds a plate-shaped second conductive section with a contact surface inside the main body of the microswitch, so that the second conductive section of the resilient component is driven by a press button on the contact surface of the second conductive terminal to preset the signal from an initial connection state to a final connection state in order to increase the distance required for controlling the signal connection and allow the resilient component to have an effective deformation and provide the best resilience of the press button.

DETAILED DESCRIPTION OF THE PREFERRED EMBODIMENTS

Figure 1:
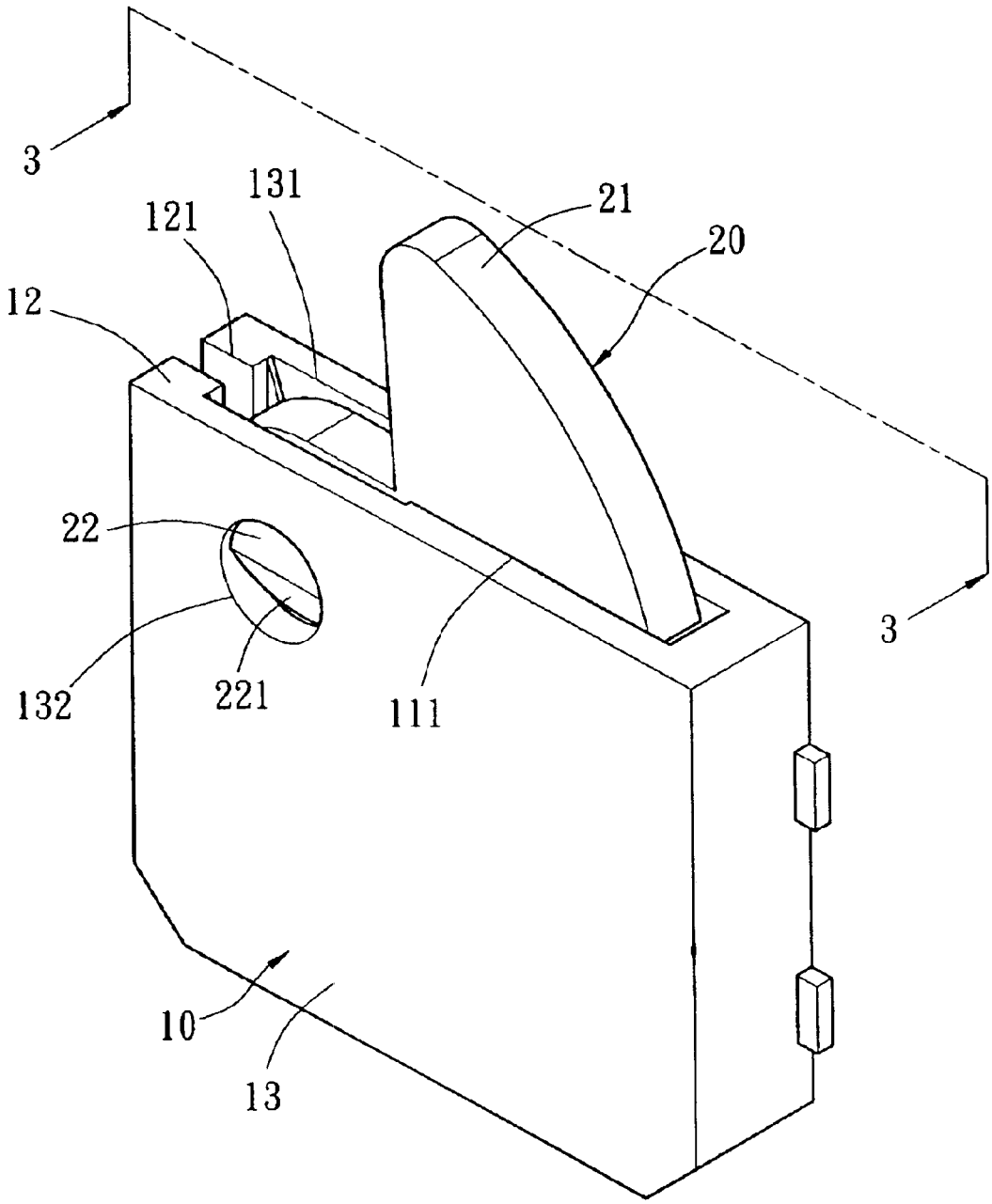
FIG. 1 is a perspective view of the present invention.
Figure 2:
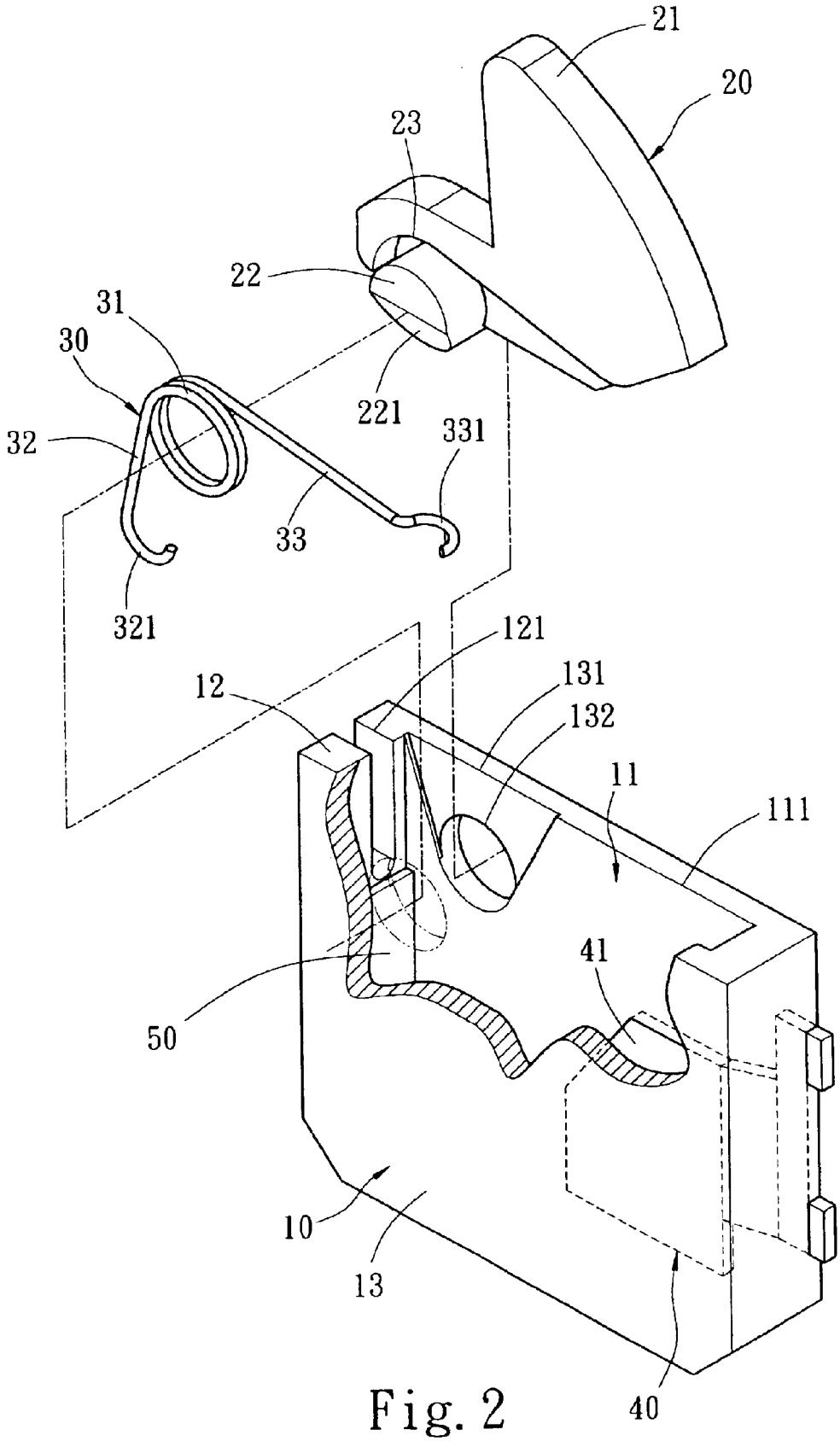
FIG. 2 is a view of the disassembled parts of the structure of the present invention.
Figure 4:
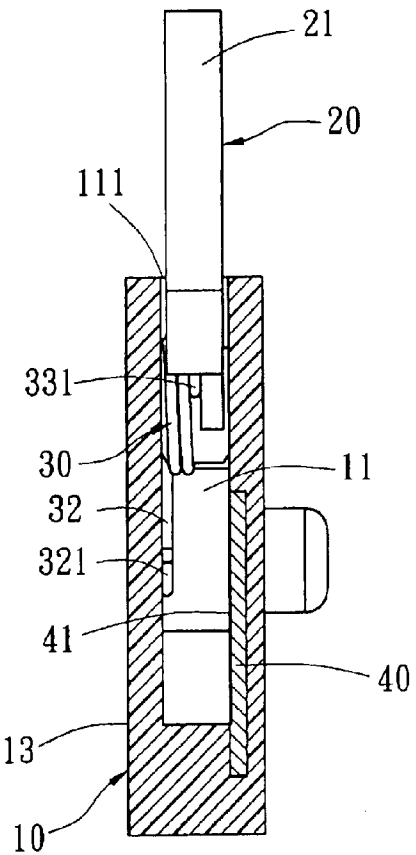
FIG. 4 is a cross-sectional view of the section 4—4 in FIG. 3.
Figure 3:
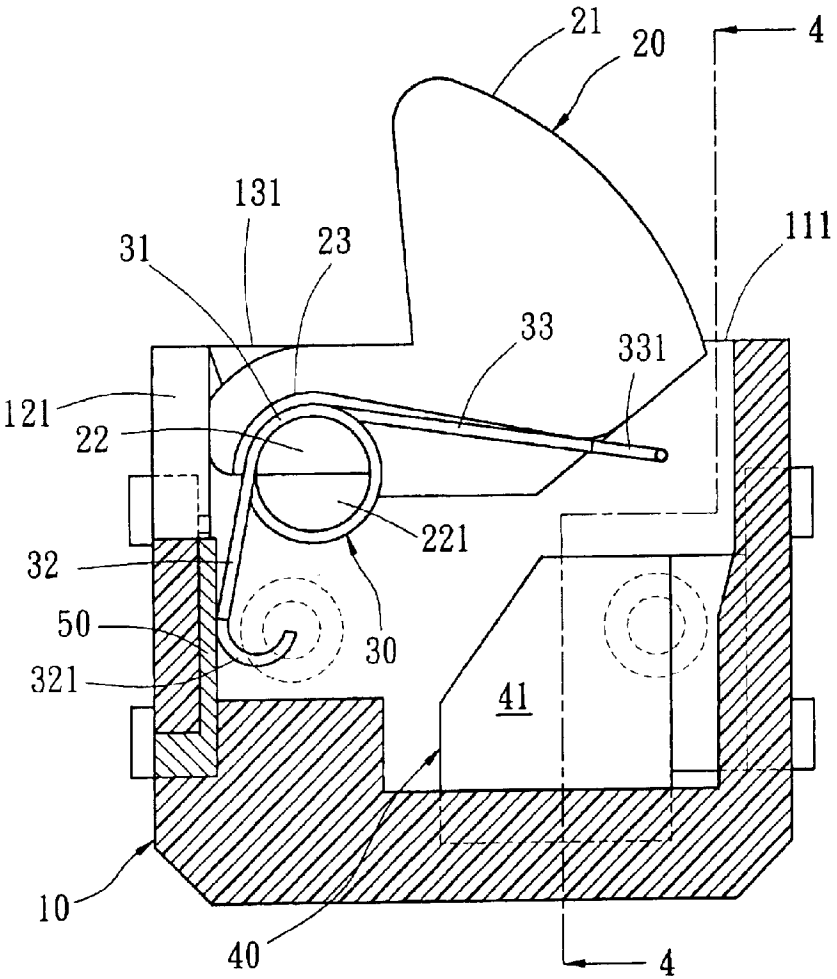
FIG. 3 is a cross-sectional view of the section 3—3 in FIG. 1.

To make it easier for our examiner to understand the objective of the invention, its structure, innovative features, and performance, we use a preferred embodiment together with the attached drawings for the detailed description of the invention.

Please refer to FIGS. 1 to 4 for the present invention. The microswitch of the invention comprises: a main body 10 having a chamber 11 therein; a first conductive terminal 50 and a second conductive terminal 40 disposed on the chamber, and the first and second terminals 50, 40 being vertically disposed in the chamber 11; a press button 20 disposed in the chamber 11 for supporting and allowing a free rotation on the main body 10; a force acting section 21 disposed at the bottom of the press button 20 for providing an elastic force to push the press button 20 up and protruded from the main body 10; and a resilient component 30 having a first conductive section 32 and a second conductive section 33 for contacting the first conductive terminal 50 and the second conductive terminal 40 respectively, wherein the first and second conductive sections 32, 33 of the resilient component 30 being bent to define a first electric connection end 321 and a second electric connection end 331, and the first electric connection end 321 and a second electric connection end 331 being bent perpendicularly; a circular hole 132 being disposed on both sides of the main body 10 corresponding to a fixing section 22 of the press button 20, and an accommodating groove 131 extended from the circular hole 132 to an open end 111 of the chamber 11, and the accommodating groove 132 being tapered from the open end 111 to the circular hole 132; an opening 121 disposed on a sidewall 12 of the main body 10 proximate the circular hole 132 and being extended to the open end 111 of the chamber 11; an aslant conductive connecting surface 221 being formed at the lower edge of the fixing section 22 of the press button 20.

Further, an assembling section 31 formed between the first and second electric conductive sections 32, 33 of the resilient component 30. An accommodating groove 23 disposed on the push button 20 at a position corresponding to the assembling section 31 comprises a fixing section 22 for connecting the resilient component 30. The first conductive section 32 and the first conductive terminal 50 of the resilient component 30 are kept constantly in contact with each other, and the second conductive section 32 is pushed down by a force provided by pressing the press button 20, and the contact surface 41 of the second conductive section 33 and the second terminal 40 should satisfy the conditions for the initial signal connection state to the final signal connection state preset by the microswitch.

Figure 6:
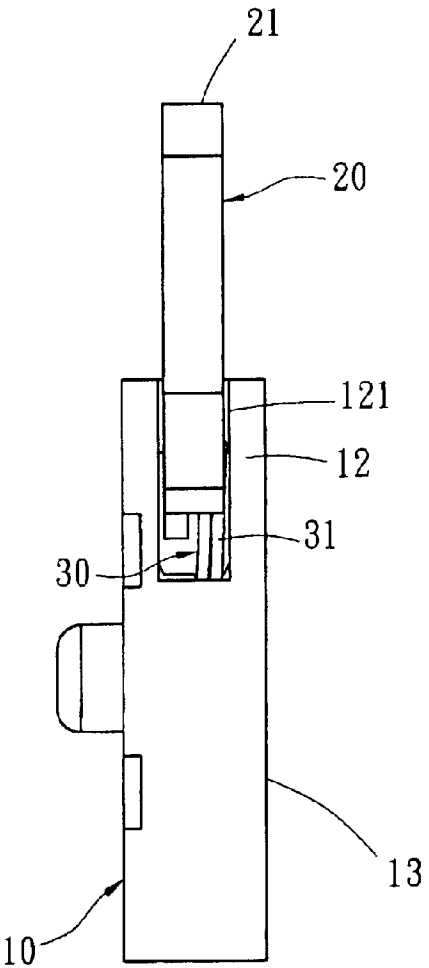
FIG. 6 is a side view of the assembly of the present invention.
Figure 5:
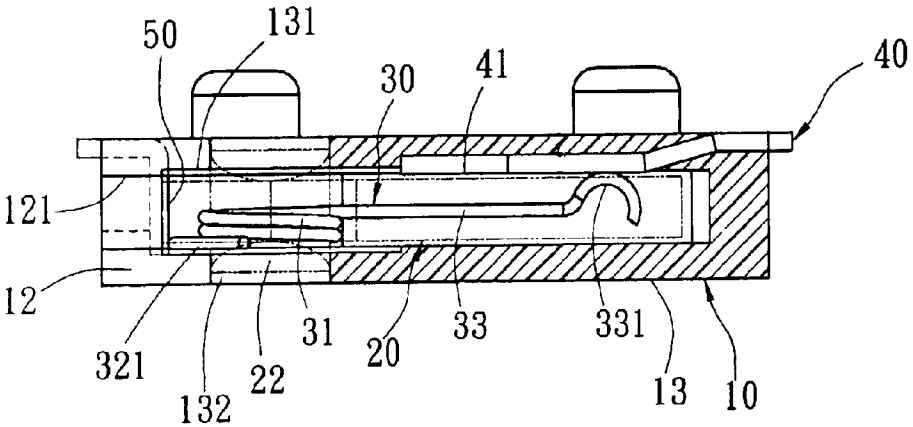
FIG. 5 is a top view of the assembly of the present invention.
Figure 7B:
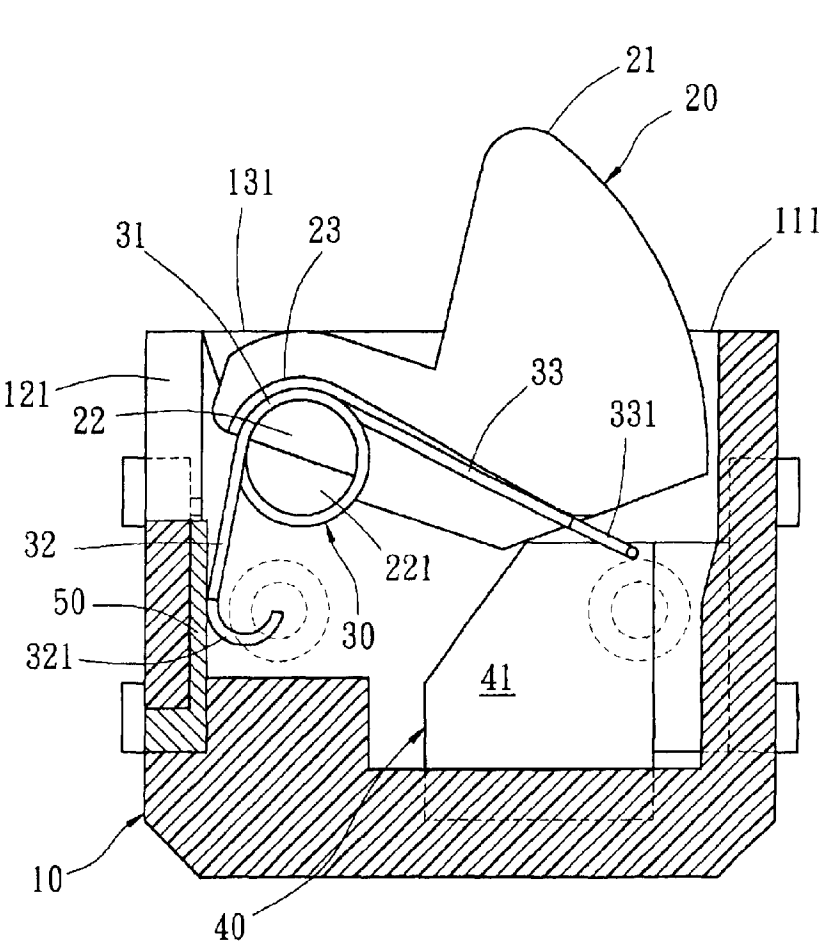
FIGS. 7A, 7B, and 7C are illustrative views of the movements made when a force is acted from the left side and the vertical direction.
Figure 7A:
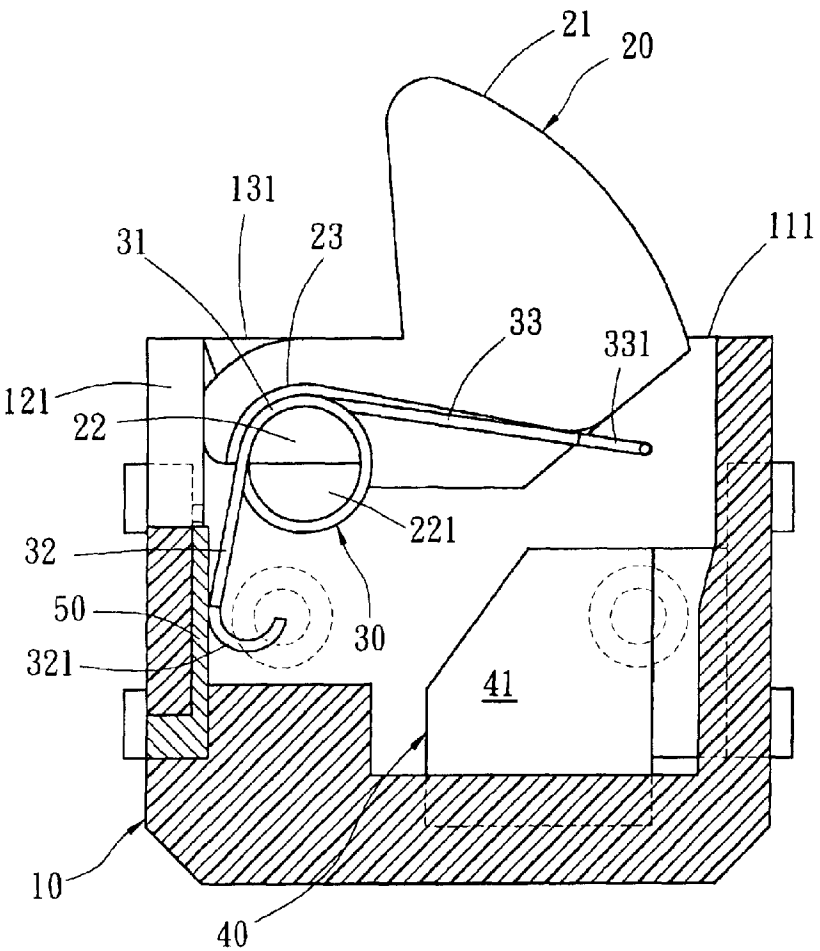
Figure 7C:
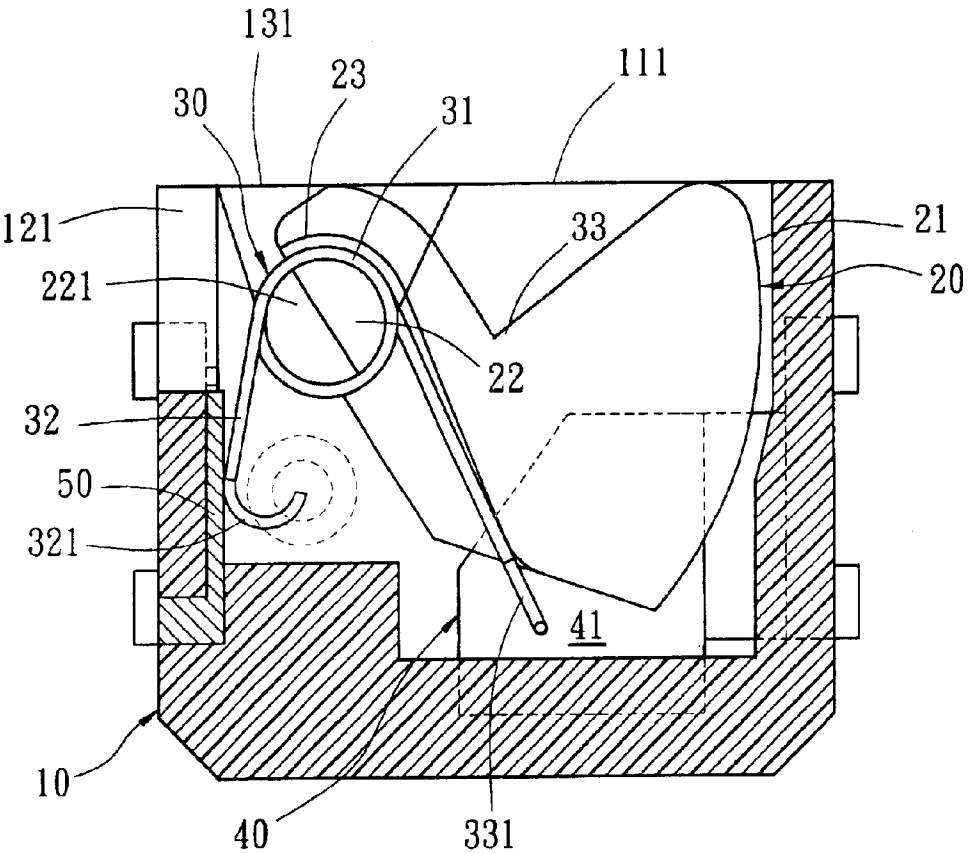

From FIGS. 5, 6, and 7A, it is obvious that the second conductive terminal 40 in a plate shape is disposed in a chamber having a contact surface 41, and the bent second electric connection end 331 of the second conductive section 33 of the resilient component 30 disposed on the top of the contact surface 41. When the press button 20 is pushed from the left direction or the vertical direction, the press button 20 will rotate and shift downward by making use of the fixing section 22 as the fulcrum, and drive the second conductive section 33 of the resilient component 30 to move down simultaneously. Since the first conductive section 32 of the resilient component 30 and the first conductive terminal 50 are always in contact with each other, therefore when the press button 20 moves to the highest point, the second electric connection end 331 of the second conductive section 33 is coupled to the contact surface 41 of the second conductive terminal 40 to define the initial signal connection state as shown in FIG. 7B; when the press button 20 moves to the lowest point, the contact surface 41 of the second conductive terminal 40 satisfies the requirement of the moving distance of the press button 20, so that the second electric connection end 331 of the second conductive section 33 can keep the contact area 41 in an electric connection state when the press button 20 is pressed as shown in FIG. 7C. Therefore, when the press button 20 moves to the lowest point, it defines a final signal connection state, and the signal traveling distance from the initial signal connection state to the final signal connection state can meet the actual moving distance design of the press button 20. The microswitch of the present invention provides the best design for the signal traveling distance. Further, since the current of the microswitch is very small, therefore when the second electric connection end moves on the contact surface 41 will not produce any spark, and will not cause danger or accidents.

Further, FIGS. 7A to 7C obviously show that the distance between the first conductive section 32 of the resilient component 30 and the second conductive section 33 is larger than the traditional microswitch. Therefore, when the press button 20 moves to the lowest point, the stored resilience of the resilient component 30 is increased; and when the press button 20 is released, the press button 20 can resume its position quickly, and effectively release the signal connection state.

Figure 8:
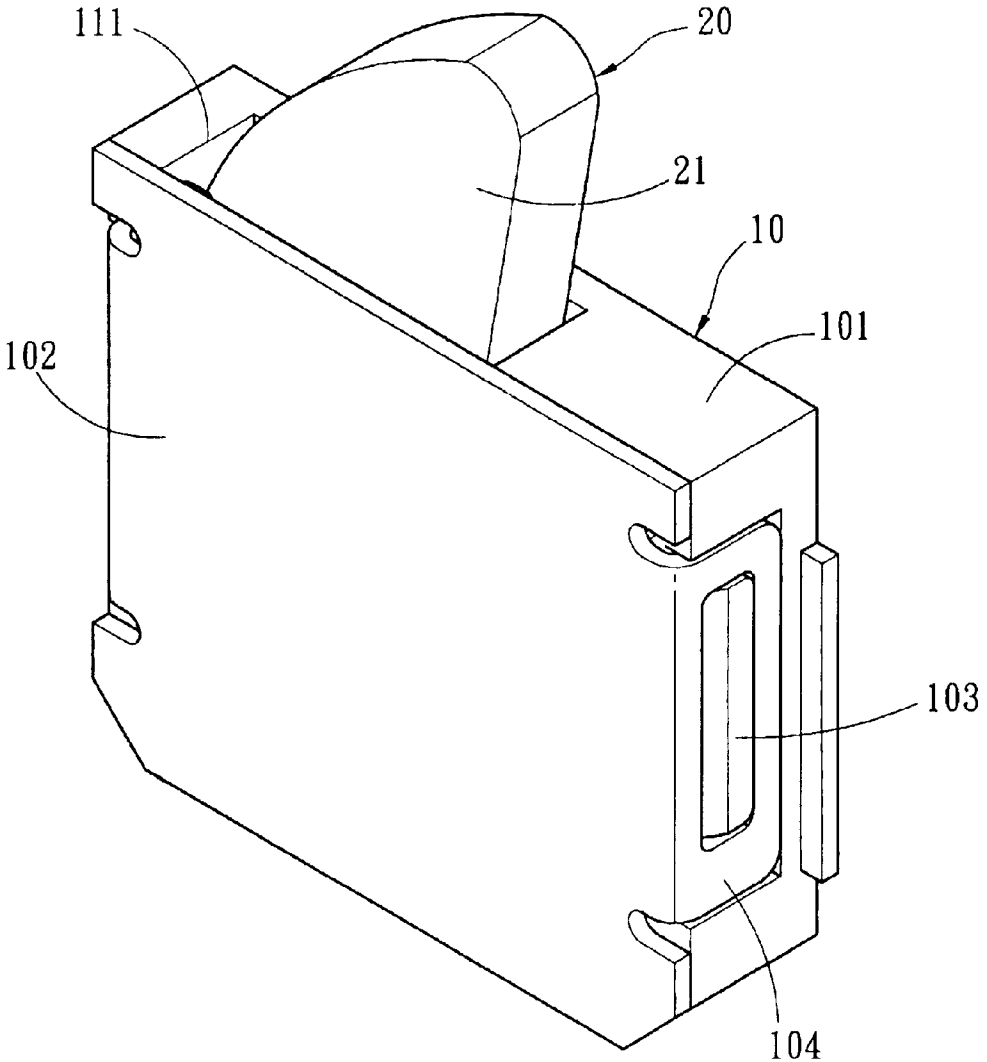
FIG. 8 is a perspective view of another preferred embodiment of the present invention.
Figure 9:
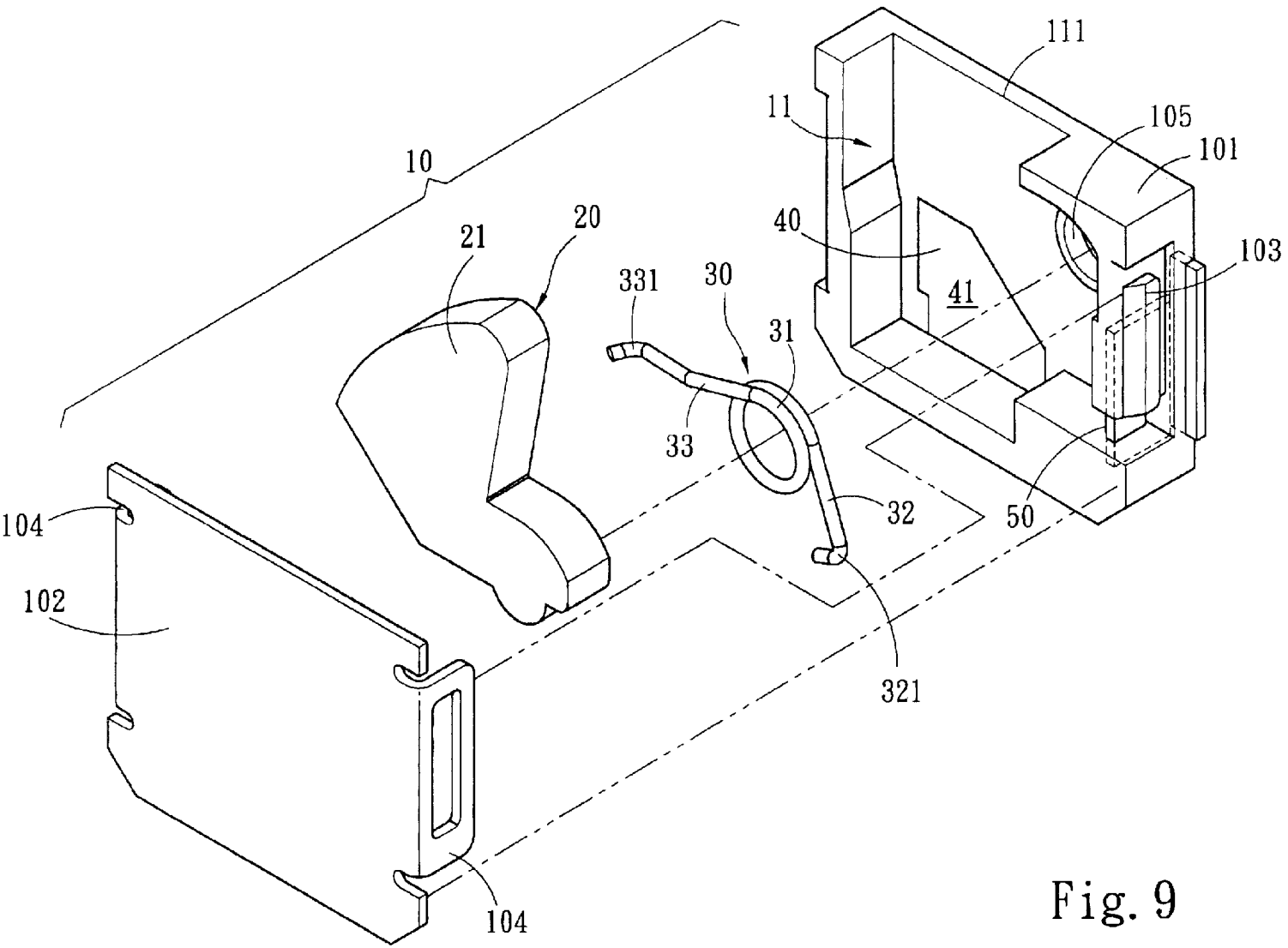
FIG. 9 is a view of the disassembled parts of the structure according to another preferred embodiment of the present invention.
Figure 10:
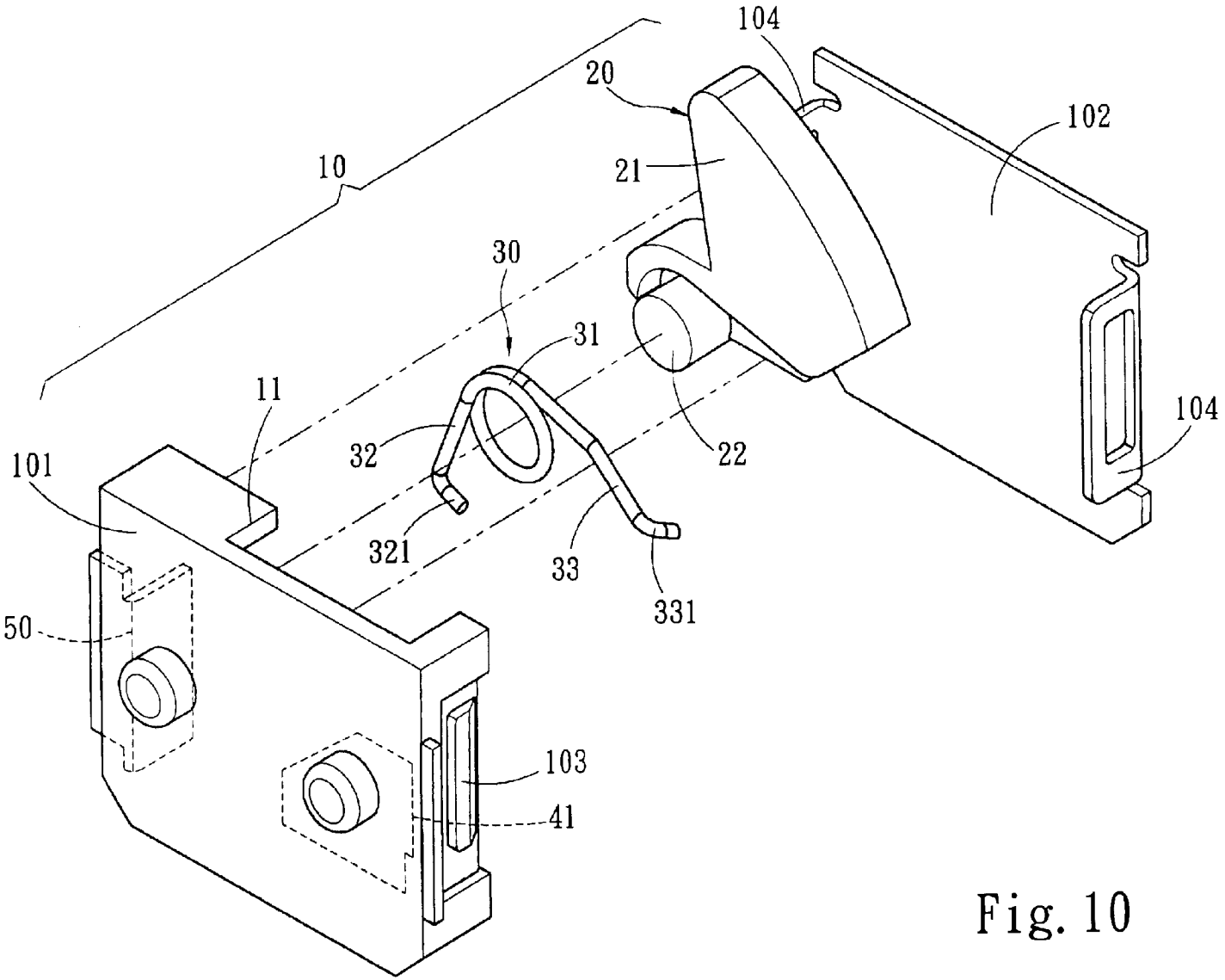
FIG. 10 is another view of the disassembled parts of the structure according to another preferred embodiment of the present invention.

Please refer to FIGS. 8, 9 and 10. In the figures, the present invention is applicable for the main body 10 made by mold-close injection molding and the main body 10 can form a chamber 11 by a base 101 and a cover 102 and their corresponding connecting section 103 and positioning ear 104, and an open end 11 is disposed on the base 101 for exposing the press button 20 and being interconnected with the chamber 11, and an axle hole section 105 is disposed on the base 101 for passing the fixing section 22 through, such that when the press button 20 is pressed, the fixing section 22 rotates freely at the axle hole section 105 and is supported by the chamber 11 in the main body 10. The pressed press button 20 drives the second conductive section 33 to move such that the technical measure taken for the second connection end 331 to be electrically coupled with the contact area 41 of the second conductive terminal 40 is similar to the description above.

While the invention has been described by way of example and in terms of a preferred embodiment, it is to be understood that the invention is not limited thereto. To the contrary, it is intended to cover various modifications and similar arrangements and procedures, and the scope of the appended claims therefore should be broadest interpretation so as to encompass all such modifications and similar arrangements and procedures.

What is claimed is:

1. A microswitch comprising a main body having a chamber therein, and the main body having a first conductive terminal and a second conductive terminal disposed in the chamber, a press button disposed in the chamber for supporting and allowing free rotation on the main body, a force acting section disposed at a bottom of the press button for providing an elastic force to push the press button up and protruded from the main body; and a resilient component having a first conductive section and a second conductive section for contacting the first conductive terminal and the second conductive terminal respectively, said main body further comprising a base and a cover and a corresponding connecting section and positioning ear for defining the chamber and an open end disposed on said base for exposing said press button and being interconnected with said chamber, said base comprising an axle hole section, the microswitch characterized by:

an assembling section, defined between said first and second conductive sections of said resilient component;

a fixing section, coupled to said resilient component and disposed in an accommodating groove of said press button at the position corresponding to said assembling section, the axle hole section of said base being for passing said fixing section through, and the first conductive section of said resilient component being kept constantly in contact with said first conductive terminal, and said second conductive section being pressed down by a pushing force provided by said press button to contact the second conductive terminal, and said second conductive section and the contact surface of said second conductive terminal being kept in contact with each other from an initial signal connection state to an final signal connection state preset by said microswitch.

2. The microswitch of claim 1, wherein said main body on both sides of said main body comprises a circular hole and an accommodating groove being extended from said circular hole to an open end of a chamber, and an opening disposed on said main body at a position proximate to a sidewall of said circular hole and extending to the open end of said chamber, and an aslant conductive surface defined at a bottom edge of the fixing section of said press button.

3. The microswitch of claim 2, wherein said accommodating groove is tapered from said open end to said circular hole.

4. The microswitch of claim 1, wherein said first and second conductive sections of said resilient component comprises first and second conductive ends, being bent perpendicularly with each other.

5. The microswitch of claim 1, wherein said first and second conductive terminals are disposed in said chamber perpendicularly with each other.

6. A microswitch, comprising a main body having a chamber therein, and the main body having a first conductive terminal and a second conductive terminal disposed in the chamber, a press button disposed in the chamber for supporting and allowing a free rotation on the main body, said first and second conductive terminals being disposed in said chamber perpendicularly with each other a force acting section disposed at a bottom of the press button for providing an elastic force to push the press button up and protruded from the main body; and a resilient component having a first conductive section and a second conductive section for contacting the first conductive terminal and the second conductive terminal respectively, the microswitch characterized by:

said second conductive terminal being in a shape of a plate disposed in said chamber and having a contact surface, and the second conductive section of said resilient component being driven by said press button to move on the contact surface of said second conductive terminal to define an initial signal connection state to a final signal connection sate preset by said microswitch.

* * * * *